US006972743B2

(12) United States Patent
Kim et al.

(10) Patent No.: US 6,972,743 B2
(45) Date of Patent: Dec. 6, 2005

(54) ORGANIC ELECTROLUMINESCENT MODULE

(75) Inventors: Hak Su Kim, Seoul (KR); Jong Geun Yoon, Anyang-si (KR); Sung Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 369 days.

(21) Appl. No.: 10/434,473

(22) Filed: May 9, 2003

(65) Prior Publication Data

US 2004/0007987 A1 Jan. 15, 2004

(30) Foreign Application Priority Data

May 9, 2002 (KR) ..... 10-2002-0025559

(51) Int. Cl.[7] ..... G09G 3/30
(52) U.S. Cl. ..... 345/76; 345/84
(58) Field of Search ..... 345/76, 77, 78, 345/84, 87; 315/169.2, 169.3, 209; 327/108, 327/112, 83, 333

(56) References Cited

U.S. PATENT DOCUMENTS 5,306,967 A * 4/1994 Dow ..... 326/101
5,517,207 A * 5/1996 Kawada et al. ..... 345/78
5,703,501 A * 12/1997 Geisler ..... 326/96
5,856,813 A * 1/1999 Katayama et al. ..... 345/76
5,973,456 A * 10/1999 Osada et al. ..... 315/169.1
6,262,593 B1 * 7/2001 Sobelman et al. ..... 326/35
6,288,593 B1 * 9/2001 Tran et al. ..... 327/408
6,369,515 B1 * 4/2002 Okuda ..... 315/169.3
6,621,228 B2 * 9/2003 Harada et al. ..... 315/169.3

FOREIGN PATENT DOCUMENTS

JP 04-245294 1/1992

* cited by examiner

*Primary Examiner*—Bipin Shalwala
*Assistant Examiner*—Nitin Patel
(74) *Attorney, Agent, or Firm*—Fleshner & Kim, LLP

(57) ABSTRACT

An organic electroluminescent module is disclosed. The organic electroluminescent module comprises a plurality of scan lines, a plurality of data lines perpendicular to the plurality of scan lines, a plurality of light emitting diodes formed at cross regions of the plurality of scan lines and the plurality of data lines, a scan driver having inverse voltage applying transistors and ground voltage applying transistors respectively connected to the plurality of scan lines, a data driver having static current sources and ground voltage applying transistors respectively connected to the plurality of data lines, and a driver controller for controlling the scan driver and the data driver. Impurities in the organic EL module can easily be eliminated by an inverse voltage. As a result, a lifetime of the organic EL module can be prolonged and quality of display can be improved.

5 Claims, 2 Drawing Sheets

ORGANIC ELECTROLUMINESCENT MODULE

This application claims the benefit of the Korean Application No. P2002-25559 filed on May 9, 2002, which is hereby incorporated by reference.

BACKGROUND OF THE INVENTION

1. Field of the Invention

The present invention relates to an organic electroluminescent (EL) module, in which aging can be carried out in a state that the fabrication of an organic EL module is finished.

2. Background of the Related Art

Recently, the EL device is favored as a prospective self-luminescent type flat display. Of the EL devices, different from an inorganic EL device, the organic EL device requires no AC or a high voltage. Moreover, it is comparatively easy for the organic EL device to provide a variety of colors, as there are a variety of organic compounds.

Recently, researches on application of the organic EL displays to full color displays and the like are active. Particularly, a structure which has a high luminance even at a low voltage is under development.

The inorganic EL device has a field excited type light emission. Different from this, the organic EL device has a so-called carrier injection type light emission, in which a light is emitted as a hole is injected from an anode and an electron is injected from a cathode. A positive carrier and a negative carrier injected from the two electrodes move to opposite electrodes, and when they couple, an exciton is formed. A light emitted when the exciton is moderated is a light emission from the organic EL device.

The problem of defects is very important in the organic EL device. Particularly, the problem of short circuit occurred at the anode and the cathode due to impurities, such as particles from a substrate, is very important, along with a substrate cleaning problem.

In order to eliminate such substrate problems in advance, though the substrates are subjected to aging or burning in manufacturing, the particles cannot be removed fully.

As another method for solving the problem, the short circuit is removed by aging in a state an organic EL panel is fabricated. However, short circuit occurred as time goes by caused by particles is still a cause of defective modules.

Thus, there have been requirements for aging in a modular state for solving the problem.

SUMMARY OF THE INVENTION

Accordingly, the present invention is directed to an organic electroluminescent (EL) module and a method for aging the same that substantially obviates one or more of the problems due to limitations and disadvantages of the related art.

An object of the present invention is to provide an organic electroluminescent (EL) module and a method for aging the same, in which aging can be carried out in a state fabrication of the organic EL module is finished.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the organic EL module includes a plurality of scan lines, a plurality of data lines perpendicular to the plurality of scan lines, a plurality of light emitting diodes formed at cross regions of the plurality of scan lines and the plurality of data lines, a scan driver having inverse voltage applying transistors and ground voltage applying transistors respectively connected to the plurality of scan lines, a data driver having static current sources and ground voltage applying transistors respectively connected to the plurality of data lines, and a driver controller for controlling the scan driver and the data driver.

The driver controller turns on at least one ground voltage applying transistors in the data driver for grounding a relevant data line, and, at the same time with this, the driver controller turns on at least one of the inverse voltage applying transistors in the scan driver for applying an inverse voltage to a relevant scan line.

The turn on operations of the inverse voltage applying transistors and the ground voltage applying transistors may be carried out periodically according to a predetermined waveform.

The waveform may be a pulse or a sinusoidal wave.

The turn on operations of the inverse voltage applying transistors and the ground voltage applying transistors may be carried out according to a state of a pin preset at the driver controller.

The inverse voltage applying transistors of the scan driver may apply an extent of current that can eliminate electrical abnormalities caused by impurities of an organic electroluminescent panel.

In another aspect of the present invention, there is provided a method for aging an organic EL module including a scan driver having inverse voltage applying transistors and ground voltage applying transistors respectively connected to a plurality of scan line, a data driver having static current sources and ground voltage applying transistors, and a driver controller for controlling the scan driver and the data driver, including the steps of turning on at least one ground voltage applying transistor in the data driver for applying a ground voltage to a relevant data line, and turning on at least one inverse voltage applying transistor in the scan driver for applying an inverse voltage to a relevant scan line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
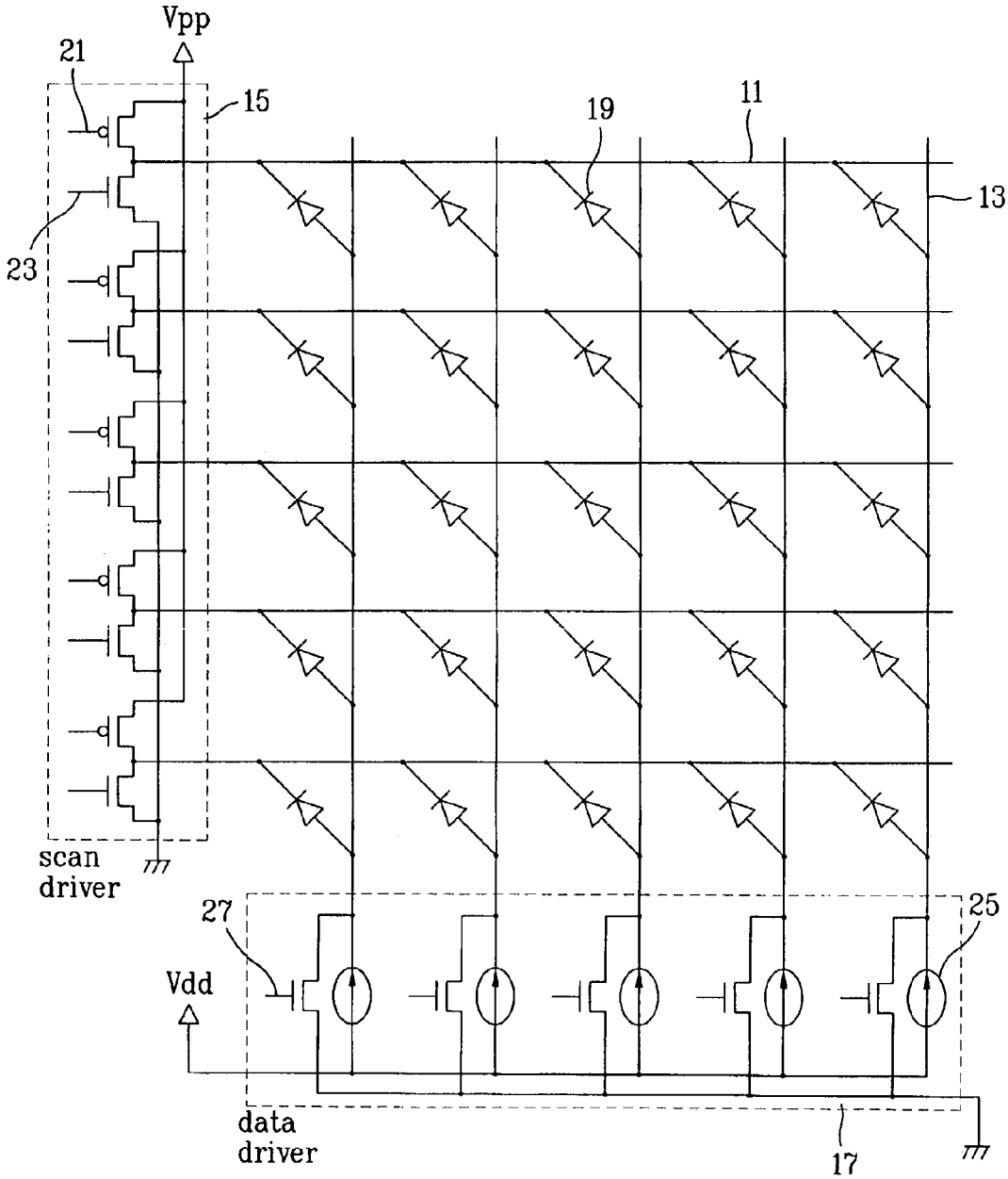
FIG. 1 illustrates a circuit of an organic EL module in accordance with a preferred embodiment of the present invention, schematically.

Reference will now be made in detail to the preferred embodiments of the present invention, examples of which are illustrated in the accompanying drawings. FIG. 1 illustrates a circuit of an organic EL module in accordance with a preferred embodiment of the present invention, schematically.

Referring to FIG. 1, the organic EL module includes a plurality of scan lines 11, a plurality of data lines 13, a plurality of light emitting diodes 19, a scan driver 15, and a data driver 17. Though not shown, the organic EL module further includes a driver controller for controlling the scan driver 15 and the data driver 17.

The light emitting diodes 19 are formed at every cross of the plurality of scan lines 11 and the plurality of data lines 13.

The scan driver 15 includes inverse voltage applying transistors 21 and ground voltage applying transistors 23 respectively connected to the plurality of scan lines 11. The data driver 17 includes ground voltage applying transistors 27 and static current sources 25 respectively connected to the plurality of data lines 13.

The scan driver 15 and the data driver 17 are connected to power sources Vpp and Vdd for providing signals to the scan lines 11 and the data lines 13.

Particularly, the driver controller turns on at least one of the inverse voltage applying transistors 21 in the scan driver 15 for applying a high inverse voltage lower than a breakdown voltage from the power source Vpp to a relevant scan line 11. At the same time with this, the driver controller turns on at least one ground voltage applying transistors 27 in the data driver 17 for grounding a relevant data line 13. As a result of this, the light emitting diode 19 can have a high inverse voltage applied thereto.

Thus, the organic EL module of the present invention includes a scan driver 15 having inverse voltage applying transistors 21 and ground voltage applying transistors 23 connected to a plurality of scan lines 11, and a data driver having ground voltage applying transistors 27 and static current sources 25 connected to a plurality of data lines 13.

The foregoing organic EL module displays a picture as follows.

In regular operation, for a fixed time period for every frame, the scan driver 15 turns on the ground voltage applying transistors 23 and applies a ground voltage to scan lines 11 to be driven, and turns on inverse voltage applying transistors 21 and applies an inverse voltage Vpp to the scan lines 11 not to be driven.

At the same time with this, for the fixed time period for every frame, the data driver 17 applies a data signal to the data line 13 to be driven through the static current source 25, and applies a ground voltage to the data lines 13 not to be driven by turning on the ground voltage applying transistors 23.

Consequently, the organic EL module of the present invention can form a picture by using a voltage difference applied to parts the plurality of scan lines 11 and the data lines 13 crosses.

However, in a case there is a defect caused by impurities, such as particles, in an inside of the organic EL panel (that is, the scan line 11 and the data line 13 are short circuited), a line form of defective picture can be formed along the scan line 11 or the data line 13. For prevention of such a defect, it is necessary to subject the organic EL module to aging.

Figure 2:
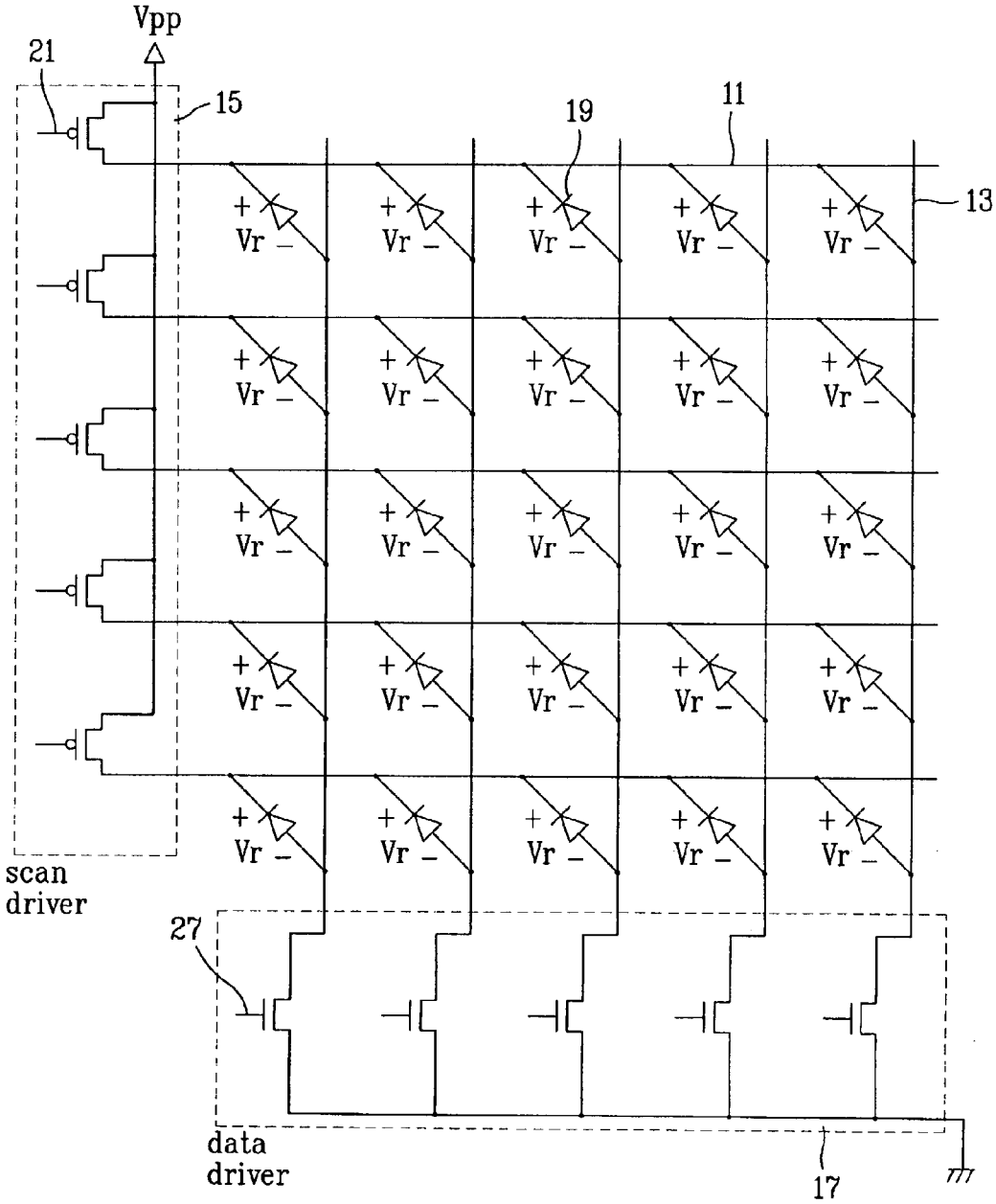
FIG. 2 illustrates an aging circuit of an organic EL module in accordance with a preferred embodiment of the present invention.

The present invention prevents a poor picture quality caused by impurities and prolongs a lifetime of an organic EL module by providing a method for aging the organic EL module or the organic EL module mounted on a mobile device, directly. FIG. 2 illustrates an aging circuit of an organic EL module in accordance with a preferred embodiment of the present invention.

Referring to FIG. 2, in the method for aging an organic EL module, a ground voltage is applied to the data lines 13 connected to the data driver 17, and an inverse voltage Vpp is applied to the scan lines connected to the scan driver 15.

In this instance, as described before, the driver controller the driver controller turns on at least one of the inverse voltage applying transistors 21 in the scan driver 15 for applying a high inverse voltage lower than a breakdown voltage from the power source Vpp to a relevant scan line 11. At the same time with this, the driver controller turns on at least one ground voltage applying transistors 27 in the data driver 17 for grounding a relevant data line 13. As a result of this, the light emitting diode 19 has a high inverse voltage applied thereto. The inverse voltage burns particles between the data lines 13 and the scan lines 11 so as to remove electrical connection between the lines at a voltage below a breakdown voltage.

In comparison of output voltages of the data driver 17 and the scan driver 15, the output voltage of the data driver 17 may be set to a low or a ground voltage, and the output voltage of the scan driver 15 may be set to a high or a voltage higher than a predetermined voltage.

Or, the organic EL module of the present invention can have an inverse voltage applied thereto by controlling operation of the data driver 17 and the scan driver 15 according a fixed waveform preset at the driver controller.

The turn on/off operation of the ground voltage applying transistors 27 and the inverse voltage applying transistors 21 in the data driver 17 and the scan driver 15 may be carried out according to a state of a pin preset at the driver controller.

It is preferable that the output voltage of the scan driver 15 is limited below to a preset voltage of a level enough to remove the particles present in the organic EL module.

Moreover, the method for aging an organic EL module of the present invention may be designed to apply the inverse voltage to the data driver 17 and the scan driver 15 on hardware basis or software basis for removing the impurity, such as particles.

Furthermore, the organic EL module of the present invention may be mounted on a mobile device, so that a user subjects the organic EL module to aging by directly selecting an aging menu or a key on the mobile device.

As described, the organic EL module of the present invention applies a ground voltage to the data lines 13 and a high inverse voltage to the scan lines 11 in a state fabrication of the organic EL module is finished. As a result, an electrical connection between the data line 13 and the scan line 11 occurred by particles can be removed, to prolong a lifetime of the organic EL module and improve a picture quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic EL module comprising:

a plurality of scan lines;

a plurality of data lines perpendicular to the plurality of scan lines;

a plurality of light emitting diodes formed at cross regions of the plurality of scan lines and the plurality of data lines;

a scan driver having inverse voltage applying transistors and ground voltage applying transistors respectively connected to the plurality of scan lines;

a data driver having static current sources and ground voltage applying transistors respectively connected to the plurality of data lines; and a driver controller for controlling the scan driver and the data driver, wherein the driver controller turns on at least one ground voltage applying transistors in the data driver for grounding a relevant data line, and, at the same time with this, the driver controller turns on at least one of the inverse voltage applying transistors in the scan driver for applying an inverse voltage to a relevant scan line.

2. The organic EL module as claimed in claim 1, wherein the turn on operations of the inverse voltage applying transistors and the ground voltage applying transistors are carried out periodically according to a predetermined waveform.

3. The organic EL module as claimed in claim 2, wherein the waveform is a pulse or a sinusoidal wave.

4. The organic EL module as claimed in claim 1, wherein the turn on operations of the inverse voltage applying transistors and the ground voltage applying transistors are carried out according to a state of a pin preset at the driver controller.

5. The organic EL module as claimed in claim 1, wherein the inverse voltage applying transistors of the scan driver applies an extent of current that eliminates electrical abnormalities caused by impurities of an organic electroluminescent panel.

* * * * *